United States Patent [19]

Portmann

[11] Patent Number: 4,499,346

[45] Date of Patent: Feb. 12, 1985

[54] SNAP ACTION MINIATURE SWITCH

[75] Inventor: Albert Portmann, Murten, Switzerland

[73] Assignee: Sodeco-Saia, AG, Murten, Switzerland

[21] Appl. No.: 515,371

[22] Filed: Jul. 19, 1983

[30] Foreign Application Priority Data

Jul. 28, 1982 [CH] Switzerland ..... 4573/82

[51] Int. Cl.[3] ..... H01H 5/28

[52] U.S. Cl. ..... 200/67 D; 200/DIG. 42

[58] Field of Search ..... 200/67 D, 67 E, 283

[56] References Cited

U.S. PATENT DOCUMENTS

| | | | |
|---|---|---|---|
| 2,495,349 | 1/1950 | Rohr | 200/67 D |
| 2,918,544 | 12/1959 | Koenig | 200/67 D |
| 3,532,840 | 10/1970 | Bauer | 200/67 D |
| 4,110,573 | 8/1978 | Doi | 200/67 E |
| 4,297,545 | 10/1981 | Darner | 200/283 X |

FOREIGN PATENT DOCUMENTS

| | | | |
|---|---|---|---|
| 618226 | 1/1945 | United Kingdom | 200/67 D |

OTHER PUBLICATIONS

Prospectus for MILTAC Switch Series XF of SAIA AG Murten, p. 1.

*Primary Examiner*—John W. Shepperd
*Assistant Examiner*—Renee S. Kidorf
*Attorney, Agent, or Firm*—Ernest F. Marmorek

[57] ABSTRACT

Two identical toggle springs of a snap action switch are inserted in the same knife-edged bearings and are spaced apart in the region of their clamping locations and are activated by the same plunger. There are two control arms connected to the toggle springs each having a movable contact. The relative distance between the control arms is limited by a lost motion buffer. Stationary contacts are positioned above and below the movable contacts. The control arms are actuated by the plunger and move in the same direction as the plunger establishing contact between one of the movable contacts of the control arms and one of the stationary contacts.

4 Claims, 3 Drawing Figures

SNAP ACTION MINIATURE SWITCH

BACKGROUND OF THE INVENTION

The present invention refers to a snap action switch.

During slow operation of an ordinary toggle switch, as is for instance the case for its use in a temperature regulator, a condition occurs before the disconnection of two touching contacts, where almost no more contact pressure exists. This leads to an increased transfer resistance which changes by order of magnitude accompanied by vibration sensitivity and eventual spark formation.

For those mode of application it is known—according to the DE-AS No. 26 19 837 for instance, to use a dual snap function and therefor construct the toggle switch in such a way that a toggle control action is started before the contact pressure sinks to zero. There are many such suggestions for solution, which, however, necessitate an increased operational path for a control tolerance at the control plunger and/or a relatively extensive manufacturing cost.

In U.S. Pat. No. 2,495,349 to Rohr a toggle switch is described the task of which is always to keep connected electrically one of two switch-current paths with the switch-feed line. This means that the current interruption which happens in a common switch during the flying time of its mobile contact needle, does *not* occur.

To solve this problem, Rohr uses two toggle springs 34, 36 lying one above the other, one of which must have an additional stamping 51. Thus, there are not two identically *same* toggle springs and their timely shifted toggle processes are only triggered when the contact pressure of the mobile contact needles has sunk to zero. The switch processes of the individual contact springs 34, 36 show *no* double toggling. Therefore, in view of the subject matter of the present application, the task of which is to create a snap action switch with dual snap action, the Rohr patent is not related.

The patents to Büsser CH-PS No. 366 317 and Spahn De-AS No. 2619 837 describe two different arrangements of toggle switches with double toggling which necessitates beside the toggle spring a further spring needle and an additional buffer.

The subject matter of the present application also has an additional buffer, but its construction compared to what has been known necessitates a much smaller input.

SUMMARY OF THE INVENTION

It is therefore a principal object of the present invention to create a double snap action switch function with little expenditure and constructed of only a few parts.

This object is achieved in a toggle switch with dual snap function wherein two identical toggle springs of a toggle switch are inserted in the same knife-edged bearings and are spaced apart in the region of their clamping locations and are activated by the same plunger. A control arm having a movable contact at one end is connected to each toggle spring. The relative path between the control arms is limited by a lost motion buffer. Stationary contacts are positioned above and below the movable contacts. The control arms are actuated by the plunger and move in the same direction as the plunger establishing contact between one of the movable contacts of the control arms and one of the stationary contacts.

Further objects and advantages of the invention will be set forth in part in the following specification and in part will be obvious therefrom without being specifically referred to, the same being realized and attained as pointed out in the claims thereof.

BRIEF DESCRIPTION OF THE DRAWINGS

The invention will now be further described by way of illustrative and non-limiting example, with reference to the accompanying drawings, in which.

DESCRIPTION OF THE PREFERRED EMBODIMENTS

The following examplification of the invention is based on an existing snap action switch and its construction is first of all described in more detail.

Figure 1:
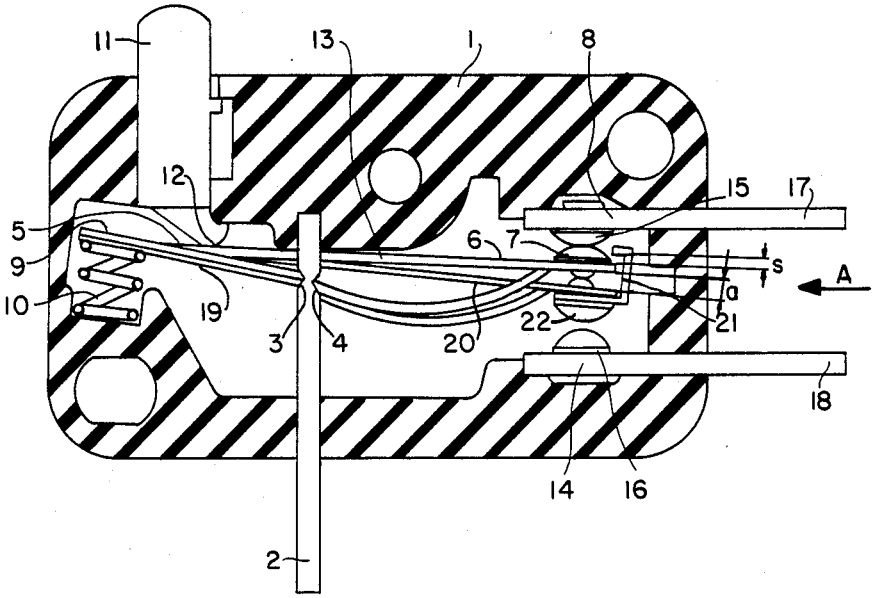
FIG. 1 is a sectional view of a snap action switch with double snap action, in accordance with an embodiment of the invention.

Referring now to the drawings, in particular FIG. 1, a metal strip 2 is solidly imbedded into a housing 1 made of insulation material. The metal strip 2 serves as an electrical feed line and as a carrier for the actual toggle mechanism and for this purpose it has two knife-edge supports 3 and 4, which serve in the known snap action switch as bearings and at the same time as carriers of a toggle spring 5 according to FIG. 2

The toggle spring 5 consists in the unmounted state of a flat stamped metal part which in mounted position is inserted at always two moulded knife edges 3*a*, 4*a* (FIG. 2) into the knife edge supports 3 and 4 (FIG. 1) and in a known manner creates the desired toggle effect. The arm of toggle spring 5 has one end 6 which with its moving contact 7 abuts in its first switching position against a first fixed contact 15. The other end 9 of the arm of the toggle spring 5 is in FIG. 1 pressed upward by a spring 10 which is propped in the housing 1. The spring 10 effects simultaneously a retractility for a control plunger 11 which is supported in the housing 1 shiftably in its longitudinal direction. The plunger 11 abuts with a contact edge 12 the median bridge 13 of the toggle spring 5. The bridge 13 forms the connection between the contact end 6 6 and the other end 9 of the arm of toggle spring 5. At a longitudinal movement of the control plunger 11 against the force of the spring 10 the control end 6 snaps in a known manner and comes to lie against a second fixed contact 16. The two electrical leads 8 and 14 are provided with fixed contacts 15, 16 respectively, and comprise two metal strips 17, 18 respectively, located in the housing 1 for electrical contacts.

In the toggle switch with double snap function, the toggle spring known from the listed DE-AS No. 26 19 837 and the control arm carrying the switch are formed by the toggle spring 5 and by a second, identical toggle spring 19, which are both inserted in the same stationary supports 3, 4 and which in the range of these bearings 3, 4 are superimposed on one another. Referring to FIG. 1, the second toggle spring 19 lies under the toggle spring 5.

The contact end 6 of the control arm of the first toggle spring 5 and the contact end 20 of the second toggle spring 19 show always in relation to one another a minimal separation a. Beyond this, the contact ends 6, 20 can during the toggle process always remove themselves one from the other by a relative distance. The size of the distance is limited by a buffer which in the exemplification of FIG. 1 is a U-shape bent bracket 21 of uneven sides which is mounted on the contact end 20 together with a second contact 22. Thereby the shorter side of the bracket 21 grasps the contact end 6 such that the two control arms 6, 20 can distance themselves one from the other additionally by the path s.

The moving contacts are mirror-image-like arranged in relation to one another, that means they are always mounted on the side of the corresponding toggle springs 5, 19 facing the fixed contacts 15, 16 and thus form together with the two fixed contacts 15, 16 a multiple switch. Thereby the distance a between the two contact ends 6, 20 in the example of FIG. 1 is warranted by the rivet heads of the two moving contacts 7 and 22 directed against one another and in rest position superimposed one upon the other.

Figure 3:
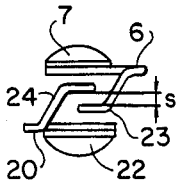
FIG. 3 is a constructively different modification of the contact portion shown in FIG. 1, viewed in the direction A of FIG. 1.

In place of the additional bracket 21 in the modification according to FIG. 1, a mutual impact can also be created by fastening one tab 23, 24 shaped in identical manner at the outer edges of the contact ends 6, 20, the two tabs 23, 24 then meshing according to FIG. 3. This permits the use of two identical toggle springs mounted in mirror-image fashion, which is a favorable solution regarding costs.

Figure 2:
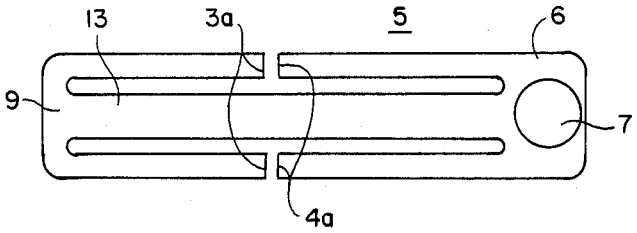
FIG. 2 is a topview of a toggle spring before installation into a snap action switch.

The toggle mechanism described in FIGS. 1 and 2 could also be construed differently, for instance with two toggle springs which have instead of the free arm of the toggle springs 5 and 19, a rigid insertion of the ends 9, and the knife-edge bearings 3 would then be unnecessary. Also a toggle mechanism with a separate spring element, for example so-called omega-springs, is feasible. All these solution possibilities have in common the inventive idea of using two identical toggle springs in unison.

The operation of the toggle switch shown in FIG. 1 is as follows:

During slow activation of the plunger 11, as occurs for example when using the switch in a temperature regulator, the lower spring in FIG. 1, that is the second toggle spring 19 is first snapped. The reason for this is that the the arm of the toggle spring 19 in its rest position is further below by the distance a than the upper toggle spring 5 arm. The speeded-up toggle spring 19 arm moves downward together with the bracket 21 until the short leg of the bracket 21 at the end of the displacement abuts against the contact end 6 and pulls its moving contact 7 away from the fixed contact 15. Thereby also the action of the toggle spring 5 is released. The same process follows also in the other toggle-direction, wherein then the control arm of the upper toggle spring 5 starts the movement.

The arrangement described permits to improve an existing toggleswitch without great expense and by extensive use of present parts, so that it has without any adjustment dual toggle function in both control directions, and yet it retains the advantageously small operational path of toggle switches known heretofore for the transfer of a control tolerance at the plunger 11.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. A snap action switch comprising, in combination, a toggle mechanism composed of two identical toggle springs, resilient means disposed below said two toggle springs, a support adapted to receive knife-edged bearings, knife-edged bearings, formed on said toggle springs, for elastically clamping said toggle springs onto said support in spaced apart position, an arm, connected to each of said toggle springs, including a movable contact near one end and having an opposite free end, each said arm being actionable at its free end, a lost motion buffer including a part connected to at least one arm limiting near the movable contacts the relative displacement between said arms, two stationary contacts respectively positioned above and below said movable contacts, each of said stationary contacts forming part of a switch to be closed upon interengagement of a movable contact with a stationary contact, said switch having three consecutive states, a plunger movable in opposite directions substantially parallel to the direction of movement of said arms, whereby the plunger, when actuated to move in one direction against the force of said resilient means, actuates the free ends of said arms so as to cause said arms to move in the same direction as that of said plunger thereby establishing contact between one of the movable contacts of said arms and one of the stationary contacts, and said switch being in the first state of said three consecutive states prior to said plunger being actuated so that one of said stationary contacts is interengaged with one of said movable contacts, said switch being in the second state of said three consecutive states after said plunger is actuated so that both of said stationary contacts are free from contact with said movable contacts, and said switch being in a third state following said second state wherein the other of said stationary contacts is interengaged with the other of said movable contacts.

2. A snap action switch as claimed in claim 1 wherein said lost motion buffer is composed of a U-shaped bucket of uneven leg lengths.

3. A snap action switch as claimed in claim 1 wherein said lost motion buffer is composed of two meshing tabs, each adjacent a toggle spring and equally spaced therefrom.

4. A snap action switch comprising in combination a toggle mechanism composed of two identical toggle springs, resilient means disposed below said two toggle springs, each of said two toggle springs comprising a thin elongated plate with two elongated slots defining a resilient connection between three adjoining arms thus formed in said plate, a support adapted to receive knife-edged bearings, knife-edged bearings, formed on the two outer arms of said plate, for elastically clamping said toggle springs onto said support in spaced apart position, each inner arm of each said plate including a movable contact near one end and being actionable at its other a lost motion buffer including a part connected to at least one arm limiting near the movable contacts the relative distance between said arms, two stationary contacts respectively positioned above and below said movable contacts, each of said stationary contacts forming part of a switch to be closed upon interengagement of a movable contact with a stationary contact, said switch having three consecutive states, a plunger movable in opposite directions substantially parallel to the direction of movement of said arms, whereby the plunger, when actuated to move in one direction against the force of said resilient means, actuates the free ends of said arms so as to cause said arms to move in the same direction as that of said plunger thereby establishing contact between one of the movable contacts of said arms and one of the stationary contacts, and said switch being in the first state of said three consecutive states prior to said plunger being actuated so that one of said stationary contacts is interengaged with one of said movable contacts, said switch being in the second state of said three consecutive states after said plunger is actuated so that both of said stationary contacts are free from contact with said movable contacts, and said switch being in a third state following said second state wherein the other of said stationary contacts is interengaged with the other of said movable contacts.

* * * * *